United States Patent [19]

Odoul et al.

[11] Patent Number: 5,044,885

[45] Date of Patent: Sep. 3, 1991

[54] MOBILE BLADE FOR GAS TURBINE ENGINES PROVIDING COMPENSATION FOR BENDING MOMENTS

[75] Inventors: Christian Odoul, Lieusaint; Marc G. F. Paty, Paris; Jean-Pierre R. Serey, Ste Genevieve des Bois, all of France

[73] Assignee: Societe Nationale d'Etude et de Construction de Moteurs d'Aviation "S.N.E.C.M.A.", Paris, France

[21] Appl. No.: 486,825

[22] Filed: Mar. 1, 1990

[30] Foreign Application Priority Data

Mar. 1, 1989 [FR] France ..... 89 02639

[51] Int. Cl.[5] ..... F01D 5/14

[52] U.S. Cl. ..... 416/196 R; 416/223 A

[58] Field of Search ..... 416/196 R, 202, 223 A, 416/237, 239, 242, DIG. 2, DIG. 5; 415/181; 29/889.21, 889.7

[56] References Cited

U.S. PATENT DOCUMENTS

| | | | |
|---|---|---|---|
| 1,027,201 | 5/1912 | Grun | 416/202 |
| 1,127,143 | 2/1915 | Wielding | 416/223 A X |
| 1,541,657 | 6/1925 | Parsons et al. . | |
| 2,282,077 | 5/1942 | Moore | 416/202 |
| 2,398,140 | 4/1946 | Heppner . | |
| 2,663,493 | 12/1953 | Keast | 416/223 A X |
| 2,915,238 | 12/1959 | Szydlowski | 416/242 |
| 3,128,939 | 4/1964 | Szydlowski | 416/242 |
| 3,851,994 | 12/1974 | Seippel | 416/223 A X |
| 3,871,791 | 3/1975 | Guy et al. | 416/242 X |
| 3,989,406 | 11/1976 | Bliss | 416/223 A X |
| 4,012,172 | 3/1977 | Schwaar et al. | 416/223 A X |
| 4,451,205 | 5/1984 | Honda et al. | 416/196 R X |
| 4,460,315 | 7/1984 | Tseng et al. | 416/237 X |
| 4,470,755 | 9/1984 | Bessay | 415/181 X |
| 4,585,395 | 4/1986 | Nourse et al. | 416/223 A |
| 4,638,602 | 1/1987 | Cavalieri | 29/889.7 X |
| 4,682,935 | 7/1987 | Martin | 416/223 A |

FOREIGN PATENT DOCUMENTS

| | | | |
|---|---|---|---|
| 0260175 | 3/1988 | European Pat. Off. . | |
| 2144600 | 3/1973 | Fed. Rep. of Germany | 416/223 A |
| 2556409 | 6/1985 | France . | |
| 609322 | 9/1948 | United Kingdom . | |
| 610786 | 10/1948 | United Kingdom . | |

OTHER PUBLICATIONS

Brown Boveri Mitteilungen, vol. 59, No. 1, Jan. 1972, pp. 42–53, A. Hohn, et al., "Die Endschaufeln Grosser Dampfturbinen".

*Primary Examiner*—Edward K. Look
*Assistant Examiner*—James A. Larson
*Attorney, Agent, or Firm*—Oblon, Spivak, McClelland, Maier & Neustadt

[57] ABSTRACT

In a mobile blade of a gas turbine engine comprising a root, a platform, and a vane forming the aerodynamic portion of the blade, the vane is arranged so that the geometric locus of the centers of gravity of successive cross-sections of the vane between the platform and the tip of the blade vane is a curve including at least one straight line portion which is offset relative to a radial straight line contained in the axial plane of symmetry of the blade root and which is joined progressively to the origin where the radial straight line intersects the junction of the vane with the platform and root of the blade. In the case of a blade with an intermediate shoulder or fin on the vane, the locus of the centers of gravity of the vane cross-sections includes a second straight line portion offset relative to the first straight line portion and connecting assembly therewith in the region of the fin.

2 Claims, 2 Drawing Sheets

MOBILE BLADE FOR GAS TURBINE ENGINES PROVIDING COMPENSATION FOR BENDING MOMENTS

BACKGROUND OF THE INVENTION

1. Field of the Invention

The present invention relates to a mobile blade of a gas turbine engine in which bending moments resulting at the blade root during operation are compensated, and is applicable both to the mobile blades of axial compressors or turbines and to propellers.

2. Summary of the Prior Art

Known aerodynamic studies of the definition of the profile of the aerodynamic portion or vane of a mobile blade have led to the provision of a geometric locus of the centers of gravity of successive cross-sections of the blade vane represented by a radial straight line passing through the longitudinal axis of rotation of the engine and contained in the median plane through the root and the platform of the blade. FIG. 1 of the accompanying drawings illustrates this arrangement diagrammatically, showing the locus of the centers of gravity of the vane cross-sections as a straight line 1 meeting the axis A of the engine and centered on the platform 2 and the blade root 3.

However, this arrangement does not meet the mechanical demands of the behavior of such a blade in operation under the action of internal stresses likely to induce deformations and due to aerodynamic forces resulting from gas stresses, to centrifugal forces, and to stresses resulting from the bending and torsion torque effects of the vane profile. The presently known solutions for defining a blade vane profile generally lead to inequality of the load distribution on the two sides of the blade root. This asymmetrical distribution of the stresses transmitted to the disc which carries the blades of a mobile stage, resulting from the forces exerted on the blade vane, does not enable the best advantage to be taken of the mechanical characteristics of disc resistance.

However, improvements have already been proposed. French Specification No. 2 556 409 discloses a blade with low centrifugal stresses in which the geometric locus of the centers of gravity of successive vane cross-sections is non-linear and includes two parts of opposite inclinations relative to a radial straight line. FIG. 2 of the drawings illustrates this solution diagrammatically, the line 1*a* representing the locus of the centers of gravity relative to the platform 2*a* and the root 3*a* of the blade. Another proposed solution illustrated diagrammatically in FIG. 3 exhibits a non-linear curve 1*b* for the geometric locus of the centers of gravity of the vane cross-sections between the platform 2*b* of the blade, on the one hand, and the radially outer tip of the blade on the other hand. The curve 1*b* in this case possesses a variable inclination which corresponds to the application of a continuous law of compensation for the bending moments.

However, these known methods have drawbacks, especially in certain specific applications. The non-linearity of the profiles obtained, and particularly of the leading and trailing edges of the blade, is the cause of additional difficulties of implementation and also makes checks in operation more difficult. These methods also impose, in order to obtain a satisfactory definition of the blade, repetitions which are often very laborious. In addition, particularly in the case of large-size blades such as turbofan blades, these methods have the disadvantage of appreciably spacing the tip of the blade from a radial position on the axis of the blade root, especially in the axial direction. This brings about clearances that are too large between the blade tip and the corresponding casing, particularly in a flow path with a conical outer wall. Similarly, in the case of blades, especially those of a large size, having lateral wings called fins, it becomes difficult to obtain the correct support between adjacent fins during operation, which interferes with their vibration-damping function.

SUMMARY OF THE INVENTION

It is an object of the invention to provide a mobile blade for a gas turbine engine which does not suffer from the drawbacks of the previously known solutions and which, in use, will nullify bending moments at the root of the blade by compensation.

Accordingly, in a gas turbine engine having an axis of rotation, a mobile blade comprising a root, a platform, and a vane forming the aerodynamic portion of said blade, said vane having a junction portion which merges smoothly with said platform and said root, said vane is arranged such that the geometric locus of the centers of gravity of successive cross-sections of said vane between said platform and the tip of said vane is a curve which has its origin in the axial plane of symmetry of said root at the point where a radial straight line passing through said axis of rotation of said engine meets said junction portion of said vane, and which merges progressively from said origin into a first straight line portion of said curve parallel to said radial straight line and axially displaced therefrom in such a manner that the corresponding vane sections are offset overall so as to nullify bending moments at said root by a compensating effect wherein the radial straight line meets the junction portion of the center of the platform-/root.

In the case of a blade having intermediate shoulders, called fins, on the vane, the curve representing the geometric locus of the centers of gravity of successive cross-sections of the vane preferably comprises, in addition to the first straight line portion, a second straight line portion situated between the fins and the tip of the vane, the second straight line portion being axially displaced from the first straight line portion and connected smoothly therewith in the region of the fins.

Other features and advantages of the invention will become apparent from the following description of embodiments of the invention with reference to the accompanying drawings.

DESCRIPTION OF THE PREFERRED EMBODIMENTS

Figures 1, 2, 3, 4, 5:
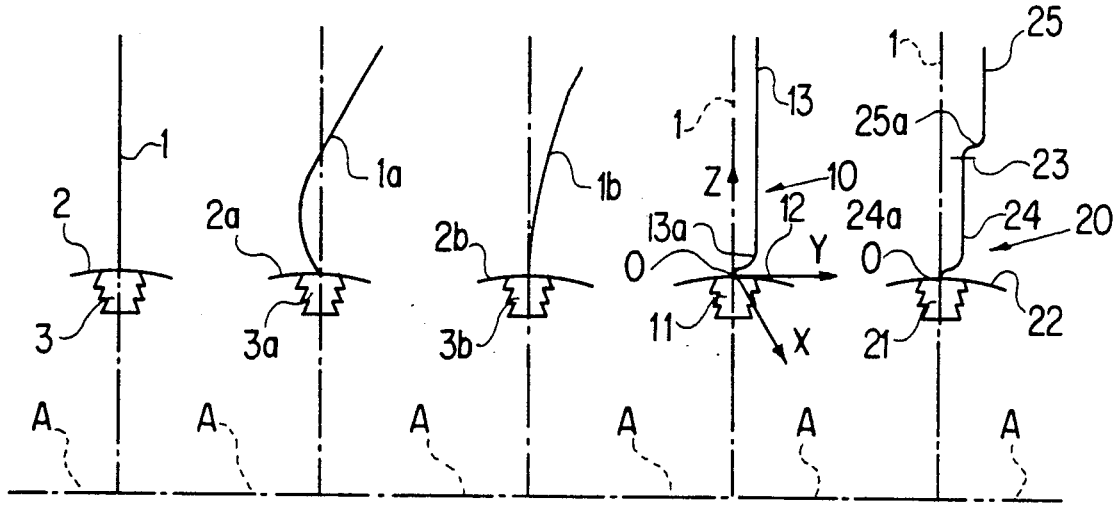
FIG.1 (PRIOR ART) FIG.2 (PRIOR ART) FIG.3 (PRIOR ART) FIG.4 FIG.5
FIG. 1 is a diagrammatic view of a blade in accordance with a known theoretical construction.
FIG. 2 is a diagrammatic view, similar to that of FIG. 1, of a blade in accordance with a known construction.
FIG. 3 is a diagrammatic view, similar to those of FIGS. 1 and 2, of a blade in accordance with another known construction.
FIG. 4 is a diagrammatic view similar to those of FIGS. 1, 2 and 3, but illustrating the construction of one embodiment of a blade in accordance with the invention.
FIG. 5 is a diagrammatic view similar to that of FIG. 4, but illustrating the construction of another embodiment of a blade in accordance with the invention.

With reference to FIG. 4, one embodiment of a mobile turbomachine blade in accordance with the invention is shown diagrammatically at 10, comprising a root 11, a platform 12, and an aerodynamic portion or vane represented by a curve 13 which depicts the geometric locus of the centres of gravity of successive cross-sections of the vane between the platform 12 and the tip of the vane. The curve 13 originates at the centre point O of the platform 12 where the radial straight line 1 (shown in dotted lines) passing through the axis of rotation A of the engine and contained in the plane of symmetry of the root 11 meets the platform 12 and the root 11. O is the origin of a coordinate system including an axial axis X, a tangential axis Y and a radial axis Z. The curve 13 has along the vane of the blade 10 a straight line portion which is tangentially offset relative to the radial straight line 1 and which corresponds to an "overall" offset of the vane cross-sections following a definition in accordance with the invention. Between the origin O of the curve 13 and its straight line portion, the curve has a transition portion 13*a* which corresponds to an evolutive part of the vane where it merges with the platform 12.

In the case of the embodiment shown diagrammatically in FIG. 5, in which the blade 20 has intermediate shoulders or fins carried laterally by the vane of the blade and symbolized at 23, the geometric locus of the centers of gravity of the vane cross-sections assumes the shape of the curve shown in FIG. 5. This curve has an origin O at the center of the platform 22 of the blade 20, a continuous evolutive transition part 24*a* leading into a first straight line portion 24 offset tangentially relative to the radial straight line 1, and extending as far as the level of the fin 23, and beyond the fin 23, a further continuous evolutive transition part 25*a* leading into a second, axially offset straight line portion 25 extending to the tip of the blade 20.

Figure 6:
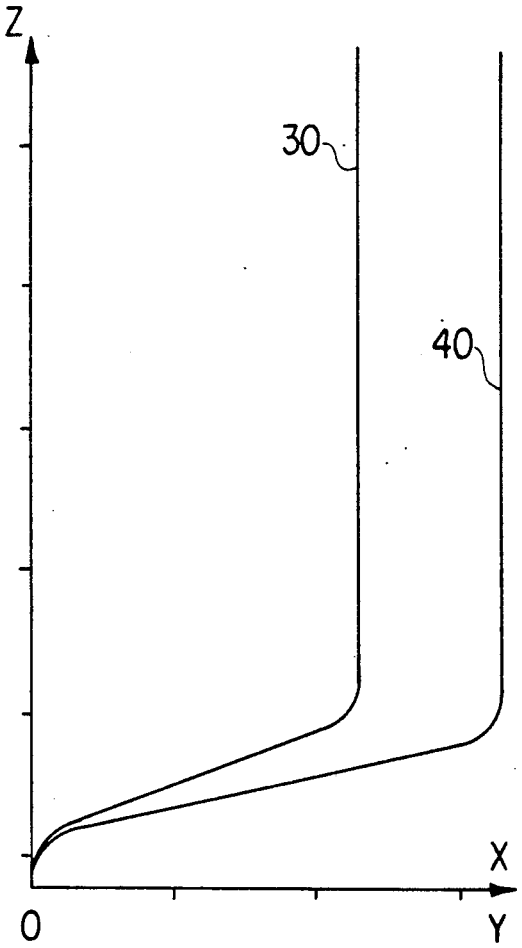
FIG. 6 shows, for a first embodiment of a blade in accordance with the invention, curves representing the geometric loci of the centers of gravity of successive blade vane cross-sections plotted with respect to coordinates in an axial direction and in a tangential direction.

FIG. 6 shows one example of the actual curves obtained in the application of the invention to a mobile turbomachine blade and representing the geometric loci 30 and 40 of the centers of gravity of cross-sections of the blade vane, plotted with reference to axial coordinates OX and tangential coordinates OY respectively. In accordance with the invention these curves 30 and 40 each comprise a straight line portion offset relative to the central radial straight line OZ.

Figure 7:
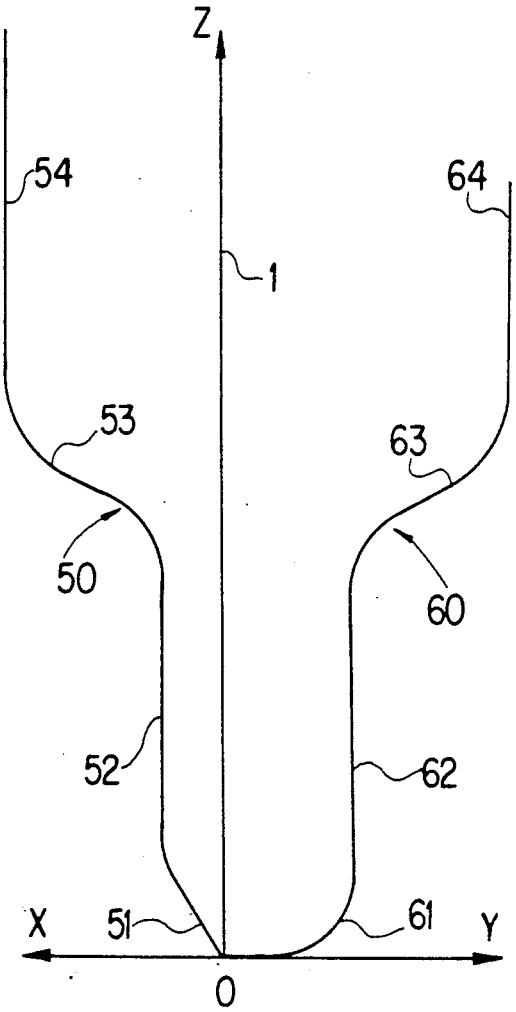
FIG. 7 shows, for a second embodiment of a blade in accordance with the invention, curves similar to those of FIG. 6 and representing the geometric loci of the centers of gravity of successive blade vane cross-sections plotted with respect to coordinates in an axial direction and in a tangential direction.

In a similar manner, FIG. 7 shows an example of actual curves obtained in the application of the invention to a mobile turbomachine blade having intermediate fins carried laterally by the blade vane. The curves 50 and 60 represent the geometric loci of the centers of gravity of the vane cross-sections respectively plotted with reference to axial coordinates and to tangential coordinates. Starting from an origin O at the center of the blade platform, each curve 50, 60 has a transition part 51, 61 corresponding to a continuous evolutive region of the vane merging with the plane of symmetry of the root of the blade, then a straight line portion 52, 62 which is offset relative to the radial straight line 1 centred on the root and which corresponds to an "overall" offset of the vane cross-sections, followed by a transition portion 53, 63 at the level of the fin which leads into a further straight line portion 54, 64 additionally offset relative to the radial straight line 1 and corresponding to the offsetting of a second "overall" part of the vane cross-sections.

Figure 8:
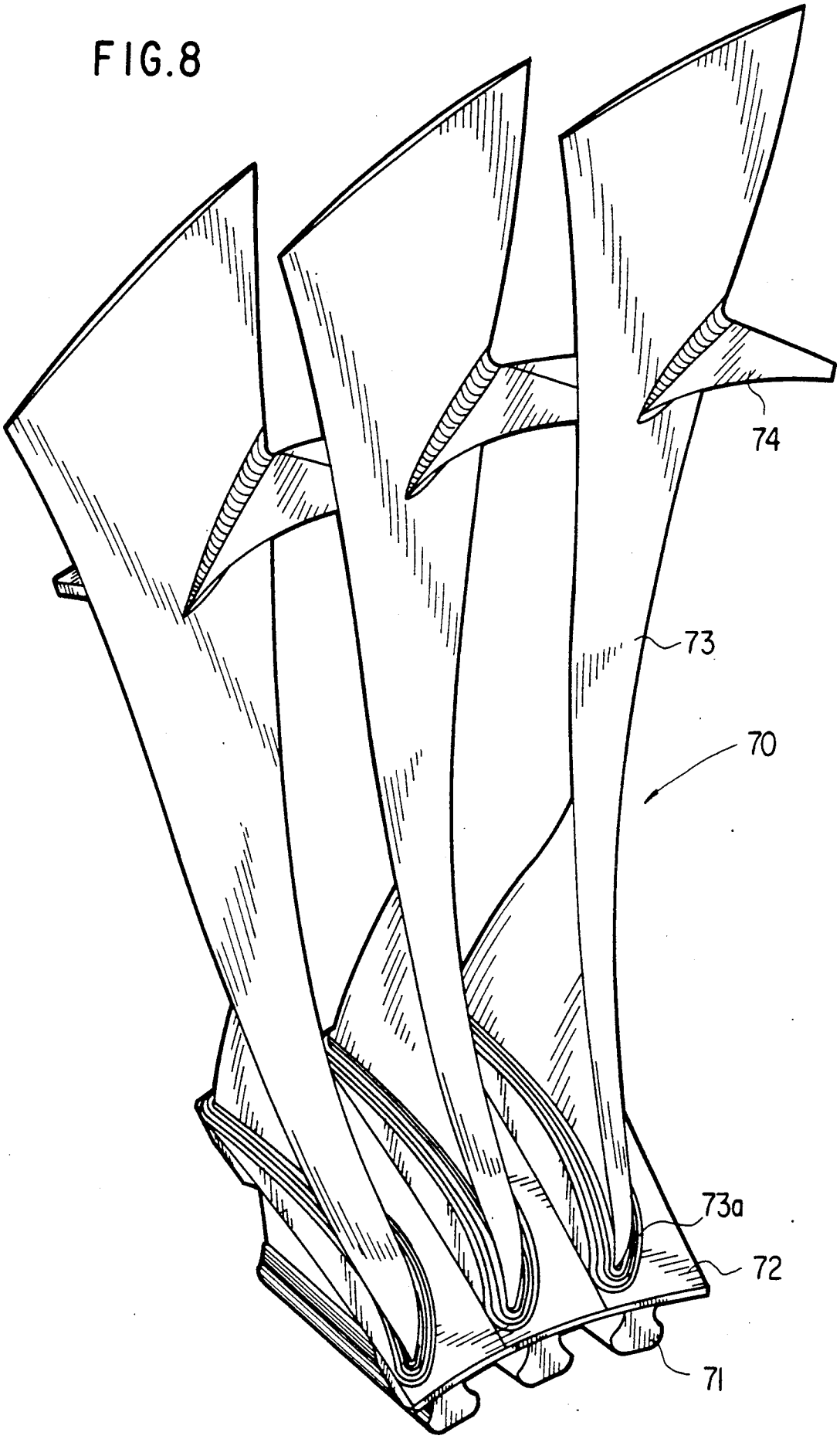
FIG. 8 is a diagrammatic perspective view of blades in accordance with the second embodiment of the invention.

FIG. 8 shows diagrammatically an example of mobile blades in accordance with the invention fitted with intermediate fins. Only a very precise geometrical analysis will enable the geometric locus of the centers of gravity of the vane cross-sections to be determined, this not being a curve which is materialized on a part. Again, there is seen in a blade 70, a root 71, a platform 72, and a vane 73 having lateral fins 74 as well as a zone 73*a* where the vane 73 merges with the platform and the root.

The offsetting of the vane cross-sections in overall parts in accordance with the invention permits the establishment of compensating moments induced in the centrifugal field, and in the case of fins, also to balance induced effects. In this way there is obtained a nullification of the bending moments at the root of the blade which is the area which, in mechanical terms, is the most stressed.

We claim:

1. A mobile blade for a gas turbine engine having an axis of rotation, which comprises:

a root, a platform, and a vane forming the aerodynamic portion of said blade, said vane having a junction portion which merges smoothly with said platform and said root, wherein said vane is arranged such that the geometric locus of the centers of gravity of successive cross-sections of said vane between said platform and the tip of said vane is a curve which has its origin in an axial plane of symmetry of said root at the point where a radial straight line passing through said axis of rotation of said engine meets said junction portion of said root and platform with said vane, and which merges progressively from said origin into a first straight line portion of said curve parallel to said radial straight line and tangentially displaced therefrom in such a manner that the corresponding vane sections are offset overall so as to nullify bending moments at said root by a compensating effect and wherein the radial straight line meets the junction portion at the center of one of the platform and root.

2. A mobile blade according to claim 1 wherein said vane carries intermediate fins, and said curve representing the geometric locus of the centers of gravity of successive cross-sections of said vane has, in the region of said fins, a continuous junction part leading to a second straight line portion situated between said fins and said tip of said vane and tangentially displaced from said first straight line portion in such a manner that the corresponding vane sections are offset overall so as to correct for the effect of said fins and nullify the bending moments at said root by said compensating effect.

* * * * *